US006883786B2

(12) United States Patent
Bebendorf

(10) Patent No.: US 6,883,786 B2
(45) Date of Patent: Apr. 26, 2005

(54) FENCE POST AND RAIL ASSEMBLY WITH CONCEALED STRENGTHENING BARS

(76) Inventor: Ronald William Bebendorf, R. W. Bebendorf, 63 Michelangelo Cr., Mackenzie Qld 4156 (AU)

( * ) Notice: Subject to any disclaimer, the term of this patent is extended or adjusted under 35 U.S.C. 154(b) by 33 days.

(21) Appl. No.: 10/162,246

(22) Filed: Jun. 4, 2002

(65) Prior Publication Data

US 2003/0222257 A1 Dec. 4, 2003

Related U.S. Application Data

(63) Continuation-in-part of application No. 10/158,520, filed on May 30, 2002, now Pat. No. 6,779,781.

(30) Foreign Application Priority Data

Jun. 5, 2001 (AU) ..... 742277

(51) Int. Cl.[7] ..... E04H 17/14

(52) U.S. Cl. ..... 256/19; 256/24; 256/59; 256/67

(58) Field of Search ..... 256/57, 65.01, 256/65.02, 65.03, 65.05, 65.08, 65.11, 65.12, 19, 24, 25

(56) References Cited

U.S. PATENT DOCUMENTS

| | | | | |
|---|---|---|---|---|
| 1,378,948 A | | 4/1921 | Hage | 52/298 |
| 3,037,593 A | | 6/1962 | Webster | 189/34 |
| 3,652,060 A | | 3/1972 | Glover | 256/19 |
| 3,822,053 A | | 7/1974 | Daily | 256/22 |
| 3,963,219 A | | 6/1976 | D'Amico | 256/24 |
| 4,133,154 A | | 1/1979 | Ruzicka | 52/598 |
| 4,148,277 A | | 4/1979 | Engle | 256/24 |
| 4,188,019 A | | 2/1980 | Meredith | 256/24 |
| 4,198,034 A | | 4/1980 | Svirklys | 256/65 |
| 4,477,059 A | * | 10/1984 | Willis | 256/65.11 |
| 4,962,914 A | * | 10/1990 | Taylor | 256/72 |
| 5,100,107 A | | 3/1992 | Latta | 256/19 |
| 5,161,783 A | * | 11/1992 | German | 256/19 |
| 5,255,897 A | | 10/1993 | Pepper | 256/24 |
| 5,447,290 A | * | 9/1995 | Workman | 256/59 |
| 5,628,495 A | | 5/1997 | Gandara | 256/24 |
| 5,639,069 A | | 6/1997 | McClure | 256/25 |
| 5,702,090 A | | 12/1997 | Edgman | 256/19 |
| 5,848,502 A | | 12/1998 | Schaefer | 52/165 |
| 5,988,599 A | | 11/1999 | Forbis | 256/24 |
| 6,039,307 A | | 3/2000 | De Zen | 256/19 |
| 6,041,486 A | | 3/2000 | Forbis | 29/453 |
| 6,345,809 B1 | | 2/2002 | Bebendorf | 256/24 |

FOREIGN PATENT DOCUMENTS

| | | |
|---|---|---|
| AU | 137015 | 4/1999 |
| AU | 715021 | 5/2000 |
| AU | 142529 | 12/2000 |
| AU | 734491 | 6/2001 |
| AU | 742277 | 12/2001 |

* cited by examiner

*Primary Examiner*—Frederick L. Lagman
(74) *Attorney, Agent, or Firm*—Rudolf O. Siegesmund

(57) ABSTRACT

A fence post and rail assembly with concealed strengthening bars in a fence system unit is disclosed. The strengthening bars have two paling slots at either end for receiving paling members. The rails connect to the posts and the palings connect to the rails. The connection between the posts and the rails is strengthened by inserting the strengthening bar through a post opening of a post to engage the palings on either side of the post with the paling slots.

48 Claims, 10 Drawing Sheets

FENCE POST AND RAIL ASSEMBLY WITH CONCEALED STRENGTHENING BARS

CLAIM FOR PRIORITY

This application is a continuation-in-part of U.S. patent application Ser. No. 10/158,520 filed May 30, 2002 now U.S. Pat. No. 6,779,781, which claims priority of Australian Patent 742277.

FIELD OF THE INVENTION

This invention relates to an apparatus and method for strengthening the connection between fence rails and fence posts in a prefabricated fencing system and for adjusting palings to the contour of the surface to which the fencing system is affixed.

BACKGROUND OF THE INVENTION

Prefabricated fencing systems are particularly useful because they minimize the time required for on site construction, do not require any specialized tools, and are quick and simple to install. One reason for the advent of prefabricated fencing systems is that home owners and professional fence builders alike have recognized that conventional post and rail fencing methods are both time consuming and aesthetically unappealing. U.S. Pat. No. 6,345,809 is a good illustration of a well-designed prefabricated fencing system. However in some instances, a strengthened connection between the posts and rails in these systems is desirable. Therefore, the need exists for an inexpensive method to improve the connection between the rail and post. A need exists for such an improved method that will not require specialized tools for assembly. A need also exists for a strengthening apparatus and method that will not detract aesthetically from the fully constructed fence. Australian Patent 742277 discloses the use of a pair of stiffening bars that straddle paling members within the rails. However, a need exists for a single unit member to provide the function of the stiffening bars that will further improve the overall strength of the fence system. A need exists for an improvement over the pair of stiffening bars when additional loads may be applied to a fence system due to a build up of snow and ice. A need exists for an improvement to the stiffeners to reduce assembly time.

Prefabricated fencing systems also have a need for the paling members to follow the contour of the ground so that the space between the fence and the ground can be minimized. Therefore, a need exists for a fence system in which the paling members can be adjusted to the contour of the ground.

SUMMARY OF THE INVENTION

The invention that meets the needs identified above is a fence post and rail assembly with concealed strengthening bars in a fence system unit. The strengthening bars each have two strengthening bar apertures for receiving paling members. A fence system unit has a post, two top rails, two or more center rails, two bottom rails, one strengthening bar post connection with a pair of opposing top rails, center rails or bottom rails, and two palings positioned one on either side of the post. The top rail, center rail(s) and the bottom rail connect to the post, the palings connect to the top rail, the center rail(s) and the bottom rail and the strengthening bars connect to the post, the top rails, center rails, the bottom rails and the palings.

Slotted projections at the ends of the top rail, center rail(s) and bottom rail engage openings on opposing faces of the post. The connection between the center rail(s), bottom rail and paling is established by dropping the paling through openings in the center rail(s) and the bottom rail. After all of the palings are inserted, the top rail is positioned to engage the palings and the post. When connected, the post and rails are at a right angle with respect to one another. Also, the rails and palings are at a right angle with respect to one another. The rail and strengthening bars are parallel with respect to one another.

The connection between the post and the top rail, the center rail and the bottom rail is strengthened by inserting the strengthening bar through each post opening of a fence panel unit. The strengthening bar is a single unit that has two opposing paling slots for receiving a paling. The strengthening bars are disposed within the top rail, the center rail and the bottom rail so that the strengthening bar straddles the paling on either side of the post. The strengthening bars will project an equal distance past the sides of the post in a fence panel unit so that a top rail center rails and a bottom rail can be attached to build the next fence panel unit.

The palings are dropped through the bottom rails until they contact a surface, such as the ground, on which the fence system is built thereby allowing the fence system to adapt to the contours of the surface.

BRIEF DESCRIPTION OF THE DRAWINGS

The preferred embodiment of the invention is illustrated with reference to accompanying drawings in which.

DETAILED DESCRIPTION OF THE PREFERRED EMBODIMENT

Figure 1:
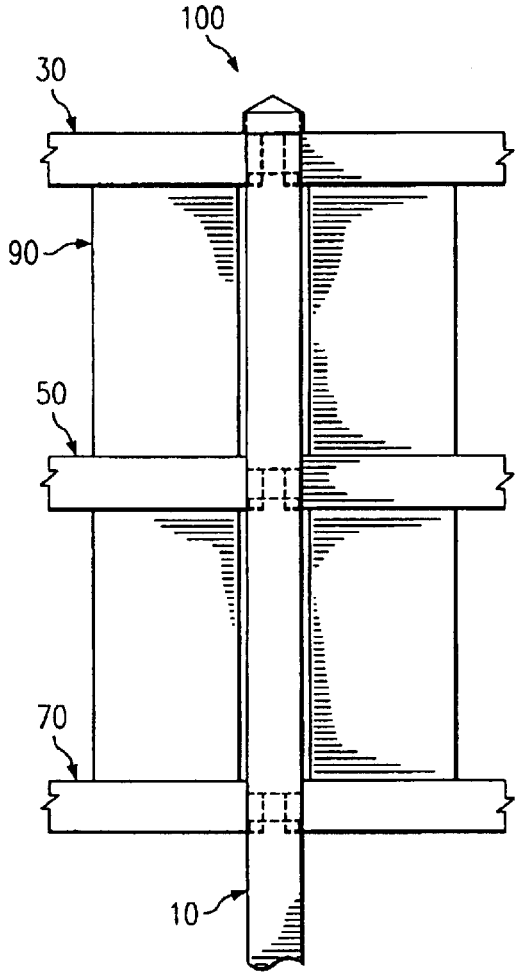
FIG. 1 illustrates a partial front view of a fence post and rail assembly including two fence palings.

FIG. 1 depicts fence assembly unit 100 having post 10, post cap 12, top rail 30, center rail 50, bottom rail 70 and paling 90. Post 10, top rail 30, center rail 50 and bottom rail 70 are formed from a rectangular section of material that is hollow and elongated. Paling 90 is rectangular in shape and elongated. Paling 90 can be either solid or hollow with internal reinforcing ribs (see FIGS. 12). Post 10, post cap 12, top rail 30, center rail 50, bottom rail 70, and stiffener 110 (see FIG. 8) of the present invention may be constructed out of fiber cement, poly vinyl chloride, metal, plastic, or any other material as determined by those skilled in the art. Strengthening bar 160 (seen in FIG. 9) may also be constructed from these materials, but is particularly well suited for injection molding out of poly vinyl chloride.

Figure 2:
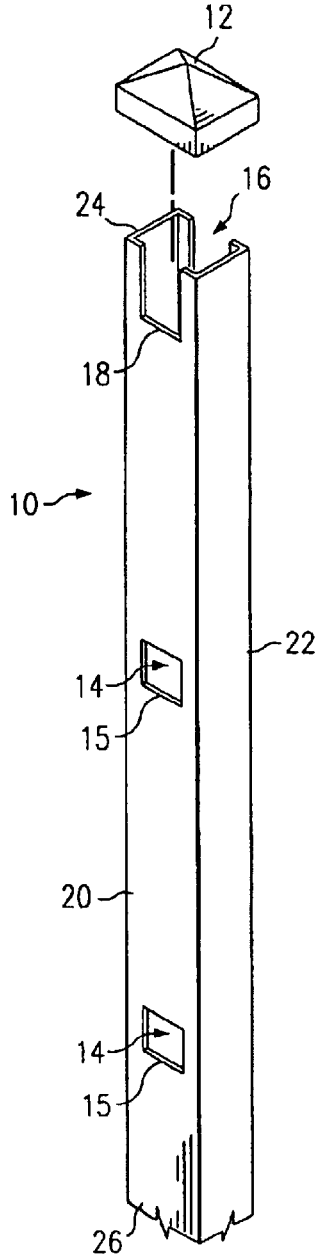
FIG. 2 illustrates a perspective view of a fence post.

FIG. 2 is an exposed view of post 10 showing post apertures 14 and post top aperture 16. Post cap 12 fits onto the top of post 10 to prevent rain from accumulating inside post 10. Post 10 is used to support the top rail 30, center rail 50 and bottom rail 70. Post 10 may have a number of post apertures 14. In the preferred embodiment, post 10 has two post apertures 14 on two opposing faces and a post top aperture 16 on its top face. Post apertures 14 can be staggered on each face of post 10 to accommodate sloping surfaces by allowing for offset engagement of top rails 30, center rails 50, and bottom rails 70. Post apertures 14 that are not used may be covered by a snap-in cover plate (not shown). Paling apertures in the rails are generally rectangular in shape and sufficiently similar in cross-sectional area to the cross-sectional area of the paling to allow for a snug yet slideable engagement. A rail may have a plurality of openings on one or both edges, depending on the location of the rail (i.e. top, center, or bottom). The paling apertures are aligned and rectangular in shape. At the ends of each rail are projections which engage the post apertures by their rail slots. The paling is rectangular in cross section and is elongated so that they may pass through the rail.

Figure 3:
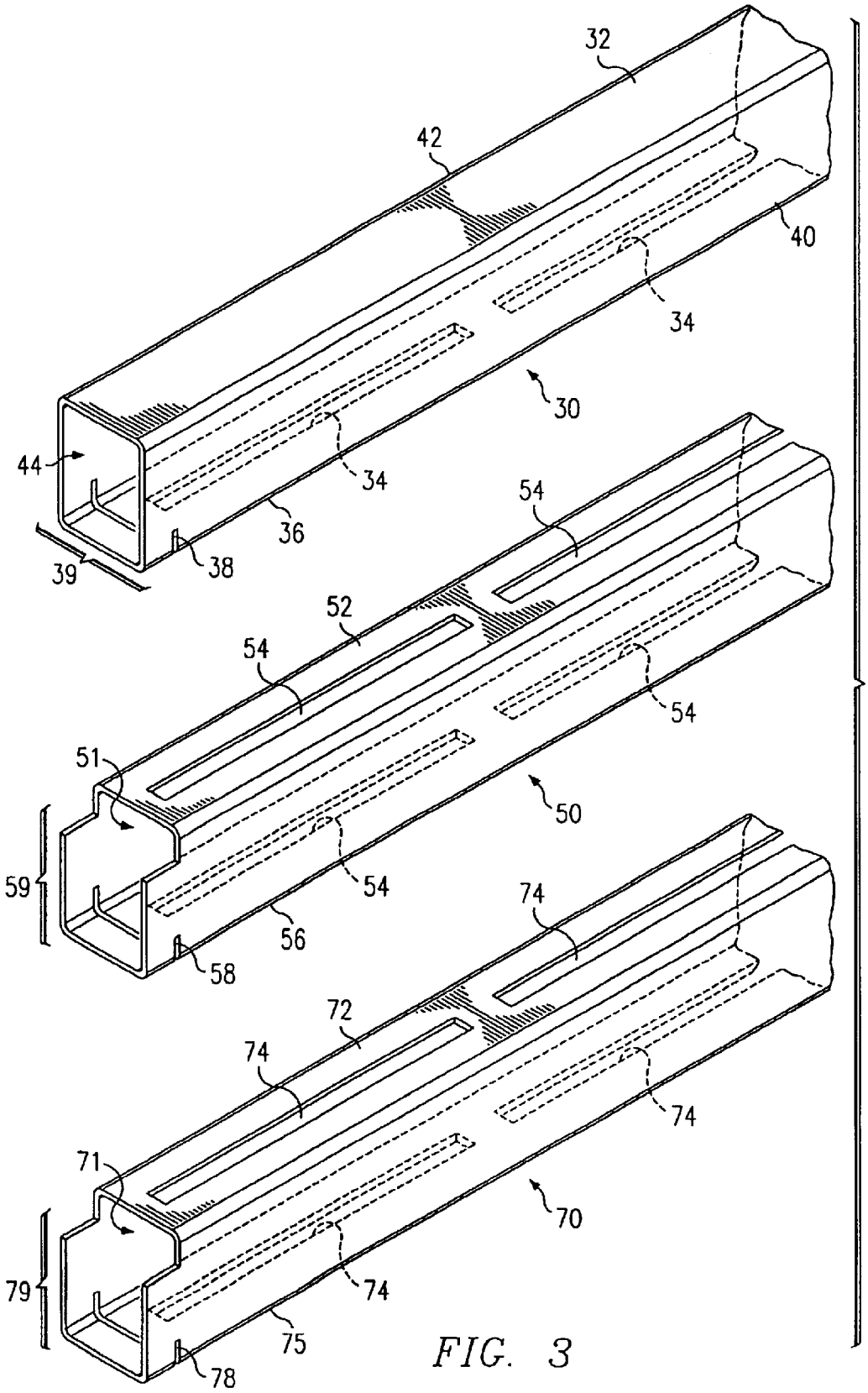
FIG. 3 illustrates a perspective view of fence rails.

FIG. 3 shows top rail 30, center rail 50 and bottom rail 70 each of which have slots for engaging post 10. Top rail 30 has top rail slot 38. Center rail 50 has center rail slot 58. Bottom rail 70 has bottom rail slot 78. Top rail slot 38 permits top rail 30 to enter post top aperture 16 and to lock down onto post top aperture edge 18. Top rail 30 has top rail projection 39 that extends from top rail slot 38 and has the same outer configuration as the rest of top rail 38 so that when top rail 30 is locked down into post top aperture 16, top rail projection 39 will fill post top aperture 16. Center rail slot 58 permits center rail 50 to enter post aperture 14 and lock down onto post aperture lower edge 15. Center rail 50 has center rail projection 59 that extends from center rail slot 58 and has an open recess from center rail slot 58 to the end of center rail 50 nearest to center rail slot 58. The configuration of center rail projection 59 allows center rail 50 to lock down on post aperture lower edge 15 and cover post aperture 14 so that no opening is visible between post aperture 14, post 10 and center rail 50. Likewise, bottom rail slot 78 permits bottom rail 70 to enter into the post aperture 14 and to lock down onto post aperture lower edge 15. Bottom rail 70 has bottom rail projection 79 that extends from bottom rail slot 78 and has an open recess from bottom rail slot 78 to the end of bottom rail 70 nearest to bottom rail slot 78. The configuration of bottom rail projection 79 allows bottom rail 70 to lock down on post aperture lower edge 15 and cover post aperture 14 so that no opening is visible between post aperture 14, post 10 and bottom rail 70. Top rail 30 has top rail paling apertures 34 on top rail bottom 36. Top rail 30 does not have paling apertures on top rail top 32. Center rail 50 has center rail paling apertures 54 on center rail top 52 and center rail bottom 56. Bottom rail 70 has bottom rail paling apertures 74 on bottom rail top 72. Bottom rail 70 also has optional bottom rail paling apertures 76 on bottom rail bottom 75. When bottom rail 70 does not have bottom rail paling apertures 76 on bottom rail bottom 75 paling 90 will not extend through bottom rail 70 to contact with the surface upon which fence assembly unit 100 is being constructed. In the preferred configuration, palings 90 extend through bottom rail 70 and extend up to top rail 30, but do not go through top rail 30. In an alternate configuration (not shown), palings 90 may extend through top rail 30 and in such a configuration, top rail top 32 would have paling apertures. When bottom rail 70 has optional bottom rail paling apertures 76, palings 90 extend through bottom rail 70 all the way to a surface, such as the ground, on which fence assembly unit 100 is installed.

Figure 4:
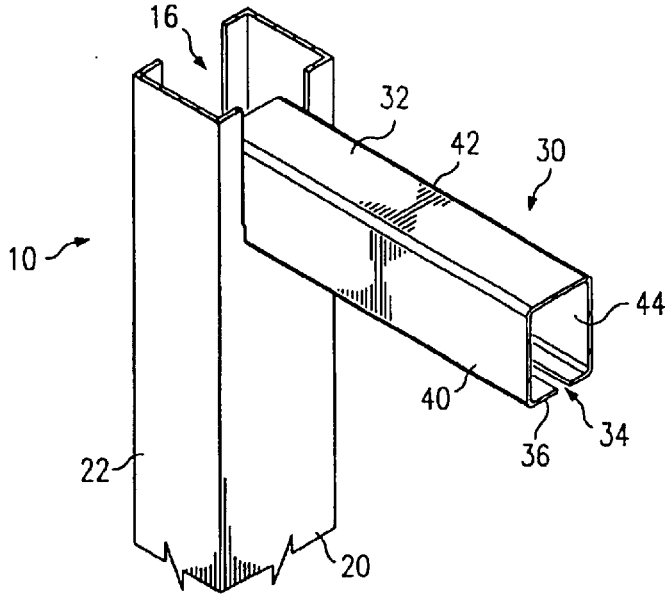
FIG. 4 illustrates a perspective view of an assembled post and top rail.

FIG. 4 illustrates the connection between post 10 and top rail 30. Top rail 30 has top rail paling apertures 34 and does not have paling apertures on top rail top 32. In an alternate configuration, top rail 30 may have optional design apertures (not shown) for receiving a plurality of different design elements (not shown) adapted for insertion into the optional design apertures. Top rail paling apertures 34 in top rail bottom 36 of top rail 30 are generally rectangular in shape and adapted for sliding engagement with palings 90. Top rail paling apertures 34 are equally spaced along top rail bottom 36. In the preferred embodiment, post 10 has one post top aperture 16 and two sets of post apertures 14 located on post walls 20. Post apertures 14 are rectangular in shape and can be staggered to allow for the stepping of rails on sloping sites.

Figure 5:
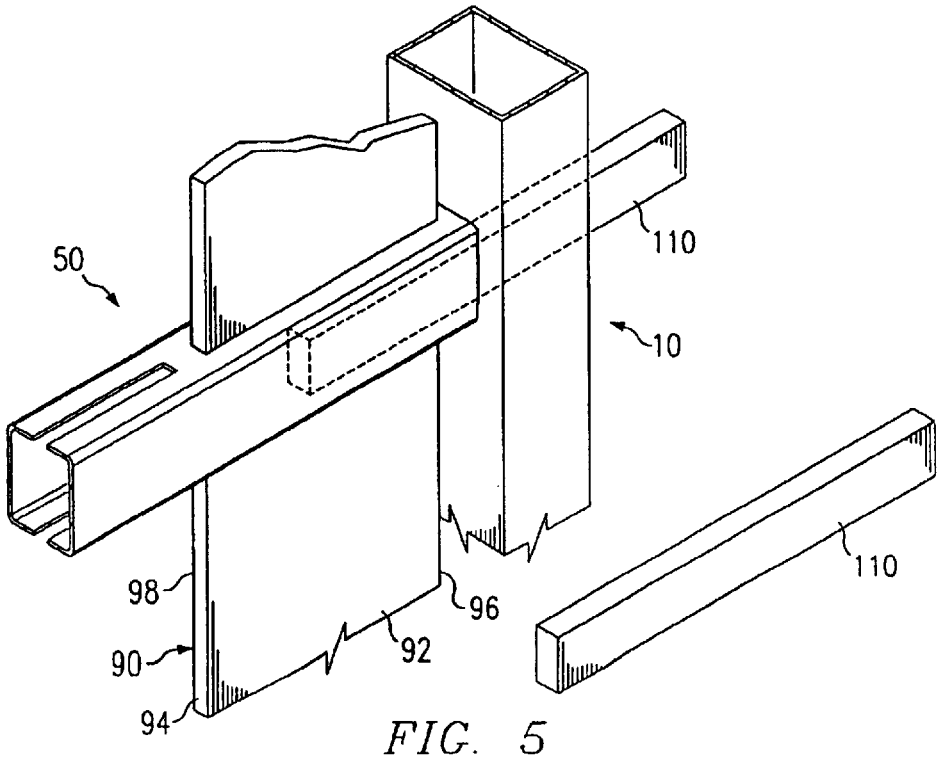
FIG. 5 illustrates a perspective view of an assembled post, a center rail, paling and stiffeners.

FIG. 5 illustrates fence assembly unit 100 with post 10, center rail 50 and paling 90. Normal assembly of fence assembly unit 100 occurs by first securing post 10 in the vertical position. Bottom rail 70 and center rail 50 may then be installed in post apertures 14. After bottom rail 70 and center rail 50 have been installed, paling 90 may be slid through center rail paling apertures 54 and, depending on the configuration, through bottom rail paling aperture 74 and bottom rail paling aperture 76 or through bottom rail paling aperture 74 only. After top rails 30, center rails 50 and bottom rails 70 have been affixed to post apertures 14 (and post top aperture 16 for top rail 30) in post 10, post cap 12 can be installed on top of post 10. When post 10 is to be a center post, post 10 will receive a bottom rail, one or more center rails, and a top rail on two opposite sides. When post 10 is to be a corner post, post 10 will receive a bottom rail, one or more center rails, and a top rail on two adjacent sides. When post 10 is an end post (i.e., one of the ends of the fence, it will only receive a bottom rail, one or more center rails and a top rail on one side. In FIG. 5, stiffener 110 is shown being inserted through center rail 50 and post 10 to reinforce the connection between center rail 50 and post 10 at post aperture 14.

Stiffeners 110 are rectangular in cross section and elongated. Stiffeners 110 can extend from one post 10 to another post 10 to increase rail strength in exposed terrain. Stiffeners 110 may be adapted to pass through the posts 10 and top rail 30, center rail 50, and bottom rail 70. Stiffeners 110 may also be adapted to straddle palings 90 and to fill the space between palings 90 and the internal walls of the top rail 30, center rail 50 and bottom rail 70. Stiffeners 110 are generally used only on top rail 30 and center rail 50 but are not limited as such. In addition, stiffeners 110 that are the full length of post 10 can be placed vertically inside post 10 before post cap 12 is positioned to further strengthen posts 10.

Figure 6:
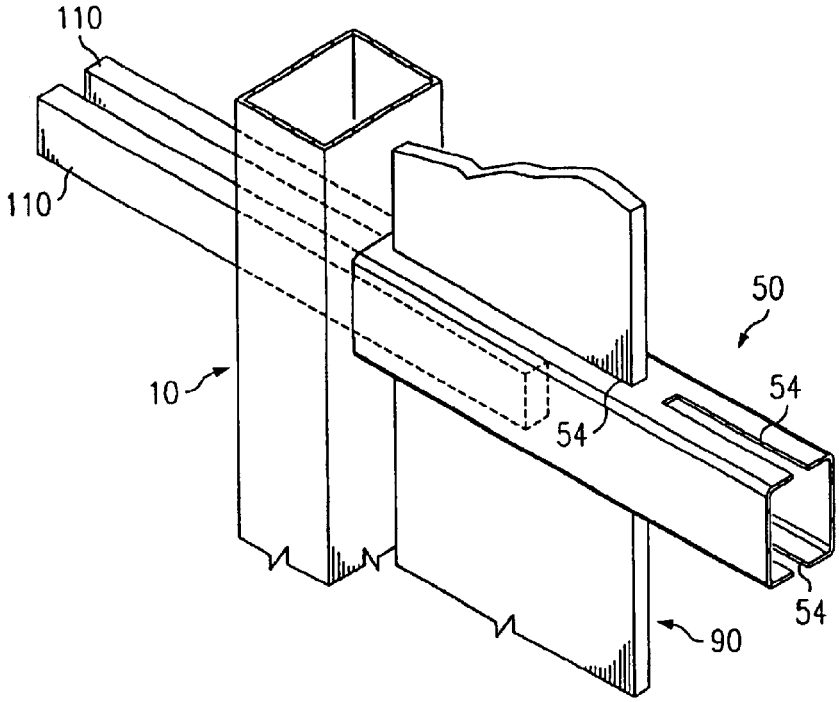
FIG. 6 illustrates a perspective view of an assembled post, center rail, paling and stiffeners.

Referring to FIG. 6, two stiffeners 110 are shown being inserted into post 10 and center rail 50. During assembly, stiffeners 110 are inserted into post 10 and center rail 50 after one side of fence assembly unit 100 (See FIG. 1) has been assembled. Stiffeners 110 straddle paling 90.

Figure 7:
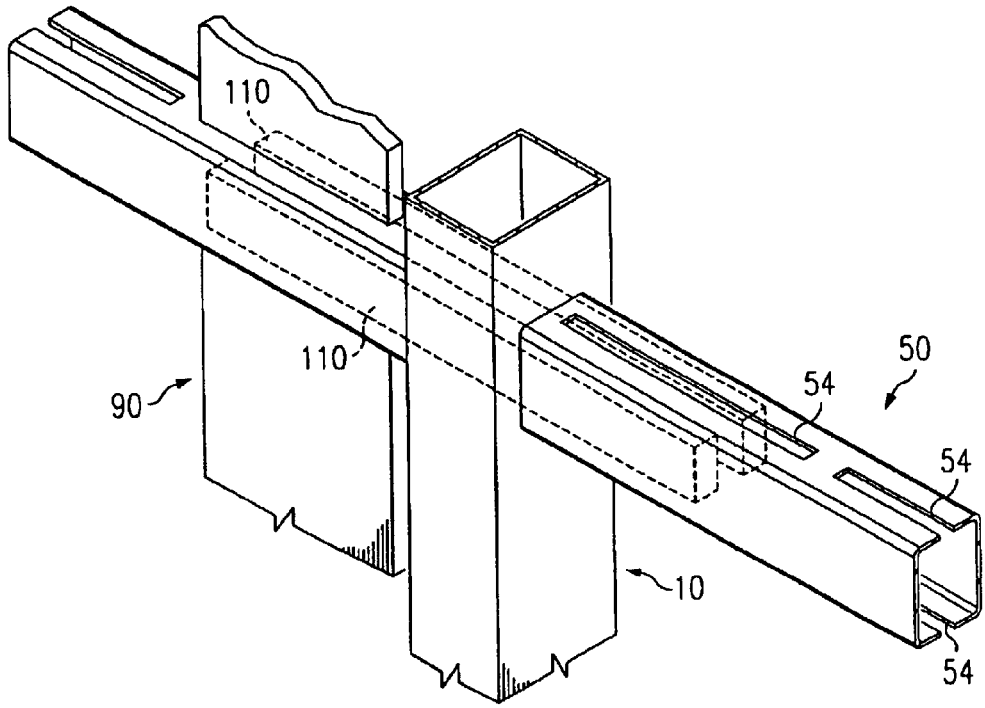
FIG. 7 illustrates a perspective view of an assembled post, center rail and paling.

FIG. 7 depicts the stiffeners 110 engaged in fence system unit 100. Paling 90 on the right side of post 10 in FIG. 7 has been removed to help illustrate stiffener 110.

Figure 8:
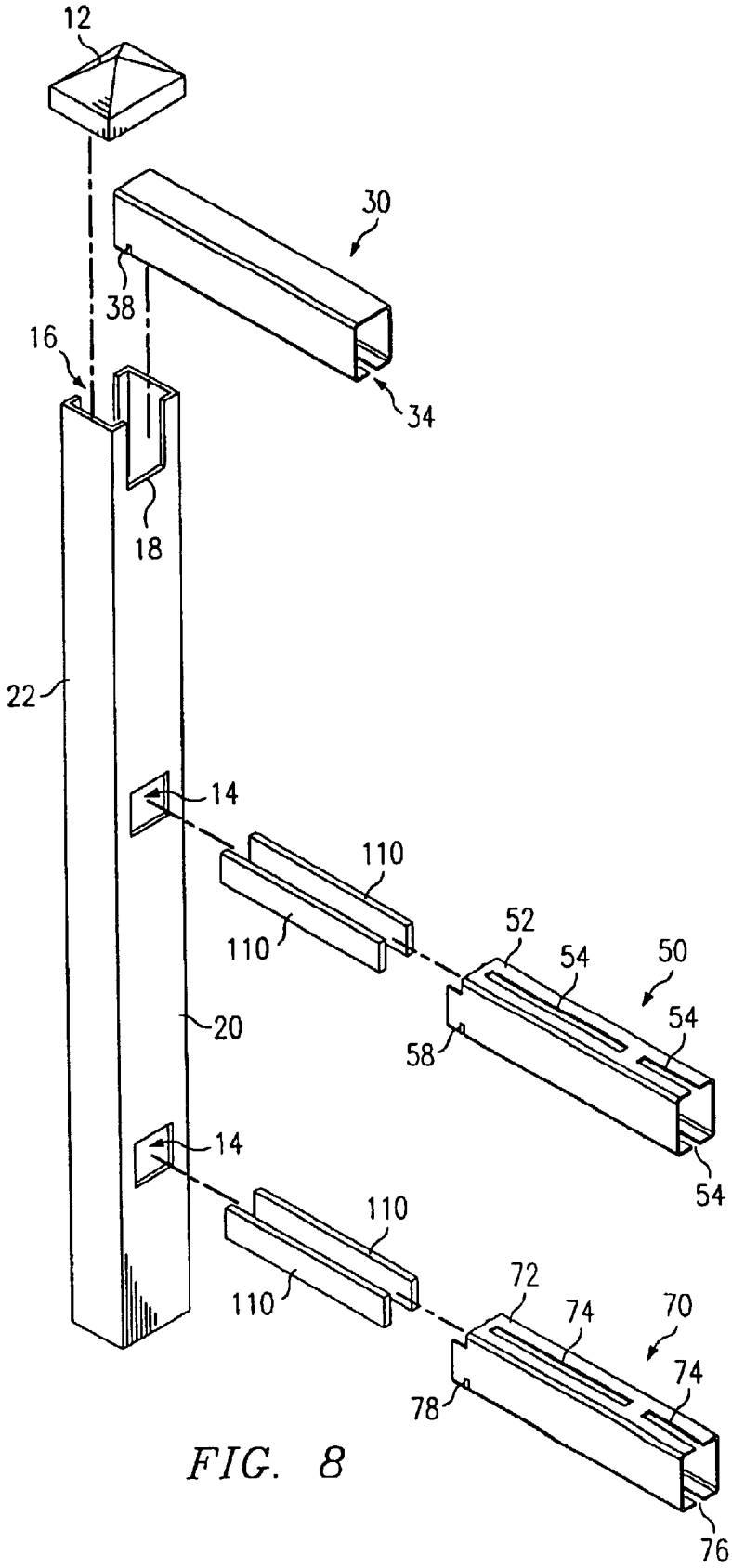
FIG. 8 illustrates a perspective view of a fence post and rail assembly including the stiffeners.

Referring to FIG. 8, stiffeners 110 are inserted into post 10 at post aperture 14 and into center rail 50 and bottom rail 70. When installed, stiffeners 110 may project a sufficient distance out of the opposing side of post 10 to accommodate the installation of center rails 50, bottom rails 70 and paling 90. Alternatively, stiffeners 110 may terminate at the center of post 10.

Figure 9:
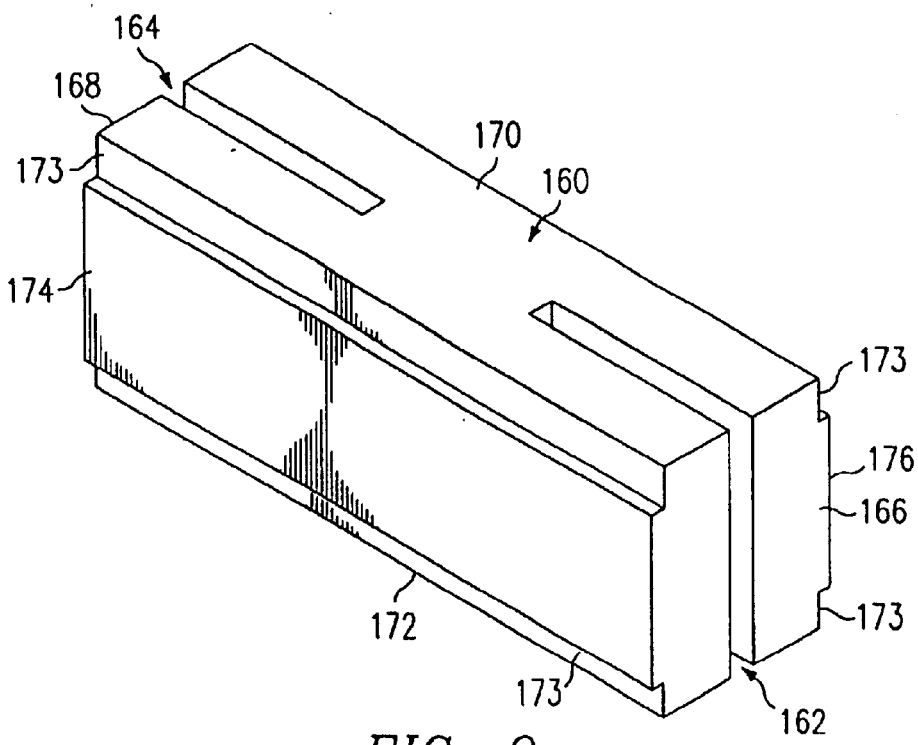
FIG. 9 illustrates a perspective view of a strengthening bar with rebates for engaging a plurality of rail ribs.

FIG. 9 depicts strengthening bar 160 which can be used in lieu of two stiffeners 110. Strengthening bar 160 has first filler panel 176, second filler panel 174, first paling slot 162 and second paling slot 164. First filler panel 176 and second filler panel 174 give strengthening bar 160 sufficient width so that first filler panel 176 and second filler panel 174 can contact the insides of top rail 30, center rail 50 or bottom rail 70 and so that first paling slot 162 and second paling slot 164 can receive palings 90. First filler panel 176 and second filler panel 174 provide improved strengthening to the fence assembly unit 100 because by engaging interior walls of top rail 30, center rail 50, and bottom rail 70. First paling slot 162 and second paling slot 164 each engage front face 92 and rear face 98 of paling 90. Strengthening bar 160 has optional rebates 173 for receiving optional ribs in the bottom rails 70, center rails 50 and top rails 30 (see FIG. 10A and 10B). In the preferred embodiment, first paling slot 162 and second paling slot 164 are of equal length so as to be able to receive the entire front face 92 of a paling 90. Strengthening bar 160 has a further advantage over stiffeners 110 because when rails are stepped (see FIG. 14) stiffeners 110 that run the full length of center rail 50 or bottom rail 70 must be installed in center rail 50 or bottom rail 70 before top rail 30 is affixed to post top aperture 16 and before center rail 50 or bottom rail 70 are affixed to post apertures 14. Stiffeners 110 require handling of two separate pieces for each rail. Stiffeners 110 do not have positive engagement with palings to stop lateral movement. Stiffeners 110 that are approximately the full length of a rail require additional handling steps to position the rails and stiffeners for insertion. Strengthening bar 160 requires handling only one unit and has positive engagement with a paling 90 received in first paling slot 162 and second paling slot 164. Strengthening bar 160 may be formed by injection molding. Alternatively, strengthening bar 160 may be formed from timber. The corners of strengthening bar 160 may be rounded. Strengthening bar 160 may be cut in half for use with a post that is at the end of the fence and that will only have rails entered on one side.

Figure 10A:
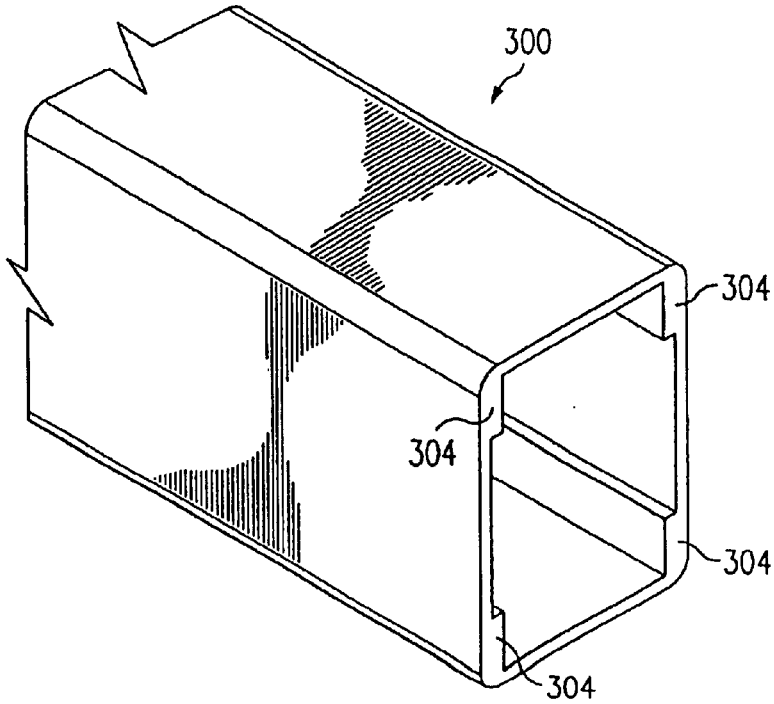
FIG. 10A illustrates an alternate rail with ribs for engaging a strengthening bar with rebates.

FIG. 10A depicts first alternate rail 300 having rail ribs 304. Rail ribs 304 shown in alternate rail 300 may be built into bottom rails, center rails or top rails. When rail ribs 304 are used, strengthening bar 160 must have rebates 173 for engagement with rail ribs 304.

Figure 10B:
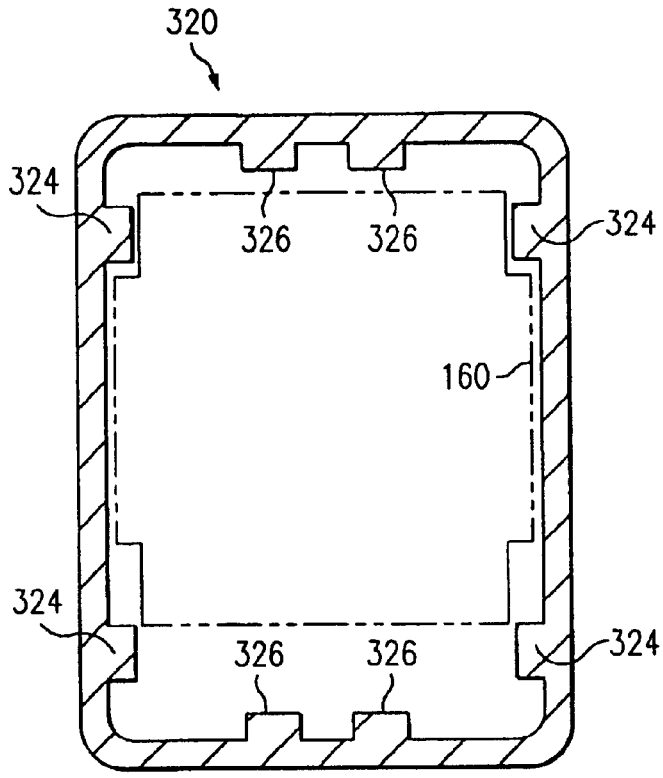
FIG. 10B illustrates a cross section of a rail having inner projections.

FIG. 10B depicts second alternate rail 320 having four rail projections 324 for guiding and receiving strengthening bar 160. Four optional rail projections 326 may be provided for receiving paling 90 and for strengthening the paling apertures of top rail 30, center rail 50 and bottom rail 70 (see FIG. 3).

Figure 11:
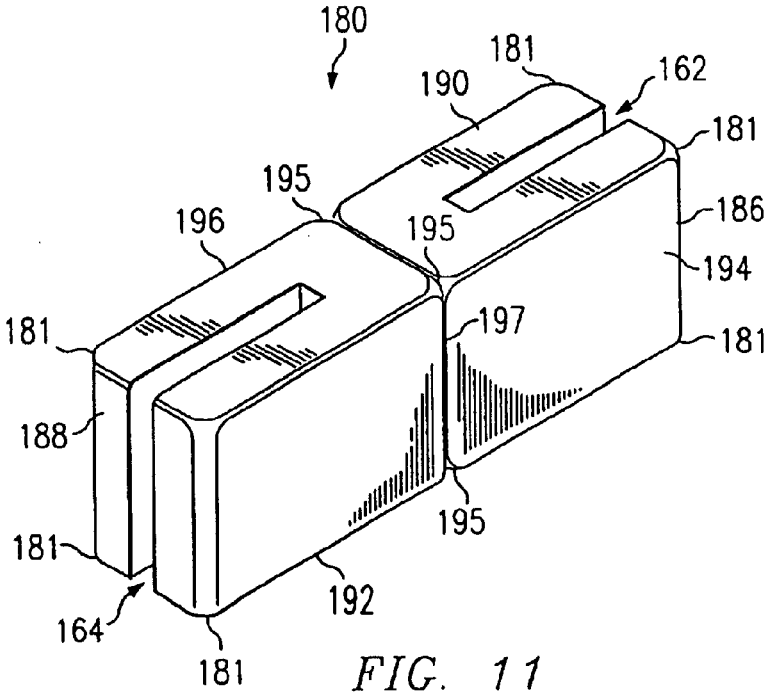
FIG. 11 illustrates a standard strengthening bar.

FIG. 11 depicts standard strengthening bar 180. Standard strengthening bar 180 is the preferred embodiment for a strengthening bar. Standard strengthening bar 180 has first paling slot 162 and second paling slot 164 as in strengthening bar 160. Standard strengthening bar 180 does not have rebates 173 and first side 194 and second side 196 will extend to contact the inner walls of bottom rails 70, center rails 50 and top rails 30. Standard strengthening bar 180 may not be used with rails that have rail ribs 304. Standard strengthening bar 180 has rounded edges 181 on each corner to make handling easier and speed insertion of standard strengthening bar 180 into bottom rail 70, center rail 50, top rail 30 and post 10. FIG. 11 illustrates that strengthening bars may be made in a variety of shapes so long as they have a single body with a first paling slot 162 and a second paling slot 164 for receiving paling 90. Standard strengthening bar 180 may be cut in half for use with a post that is at the end of the fence and that will only have rails entered on one side. In order to facilitate cutting standard strengthening bar 180 in half, optional scoring lines 197 may be placed on first side 194, second side 196, top surface 190 and bottom surface 192. Optional scoring indents 195 may be placed where optional scoring lines 197 meet at the intersection of top surface 190, bottom surface 192, first side 194 and second side 196 so that when standard strengthening bar 180 is cut in half, the newly created end will have rounded edges. Optional scoring lines 197 are meant to be guides for cutting standard strengthening bar 180 in half.

Figure 12:
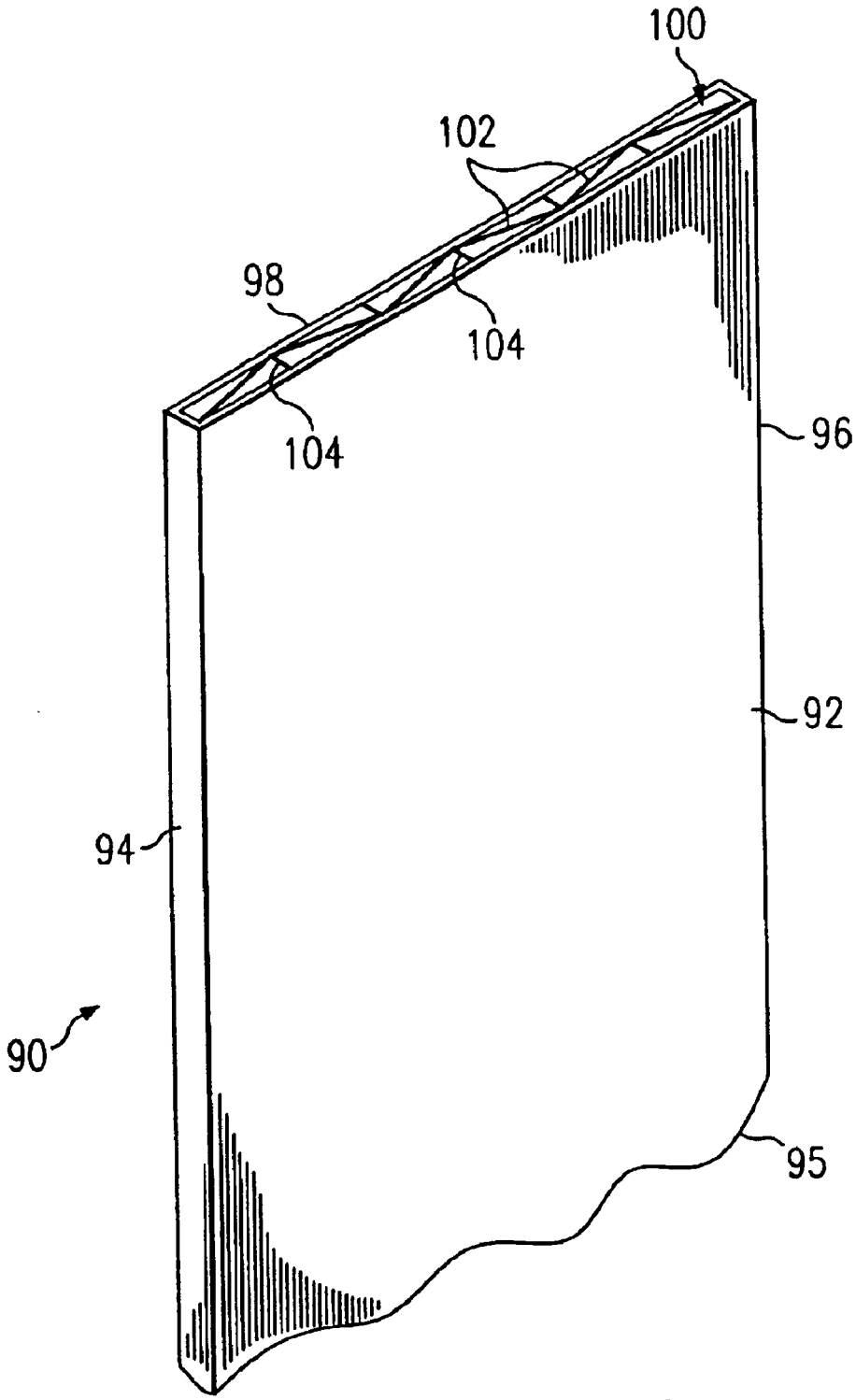
FIG. 12 illustrates a paling with reinforcing members.

FIG. 12 depicts paling 90 having front face 92, right side 96 and left side 94. Paling 90 has a hollow interior reinforced by perpendicular reinforcing members 104 and diagonal reinforcing members 102. Alternatively, paling 90 may be made of unitary construction with a solid interior. Additionally, paling 90 may be filled with a variety of sound absorbing materials known to persons skilled in the art. Further in the alternative, paling 90 may be made with a combination of perpendicular reinforcing members, diagonal reinforcing members and sound absorbing material. Further in the alternative, paling 90 may be extruded as a shell with a hollow interior and a reinforcing interior may be inserted and fixedly engaged to the shell. The reinforcing interior to be inserted in the shell may be designed for strength, for sound absorption or for a combination of both strength and sound absorption. Perpendicular reinforcing members 104 are perpendicular to front face 92. Diagonal reinforcing members 102 extend from an intersection of a perpendicular reinforcing member 104 with front face 92 to an intersection of the next perpendicular reinforcing member 104 with rear face 98 and from the intersection of a perpendicular reinforcing member 104 with rear face 98 to the intersection of a perpendicular reinforcing member with front face 92 and so on alternatively.

Figure 13:
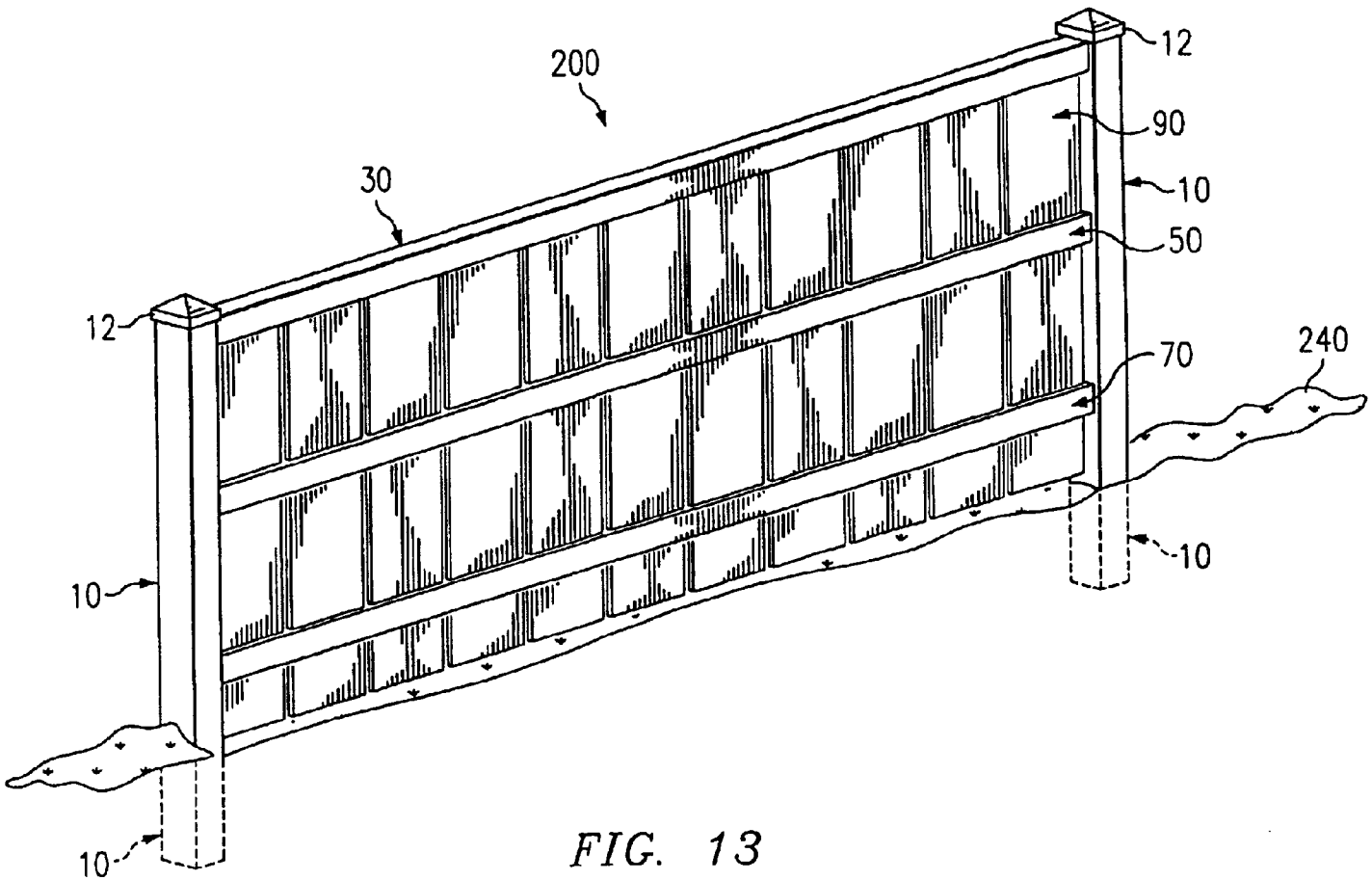
FIG. 13 illustrates a fence system unit with two posts.

FIG. 13 depicts an assembled fence panel 200 with two posts 10, top rail 30, center rail 50 and bottom rail 70. Posts 10 are positioned in surface 240. Normally, posts 10 are placed in post holes (not shown) and surface 240 is the ground. Palings 90 extend through bottom rail 70 to rest on surface 240.

Figure 14:
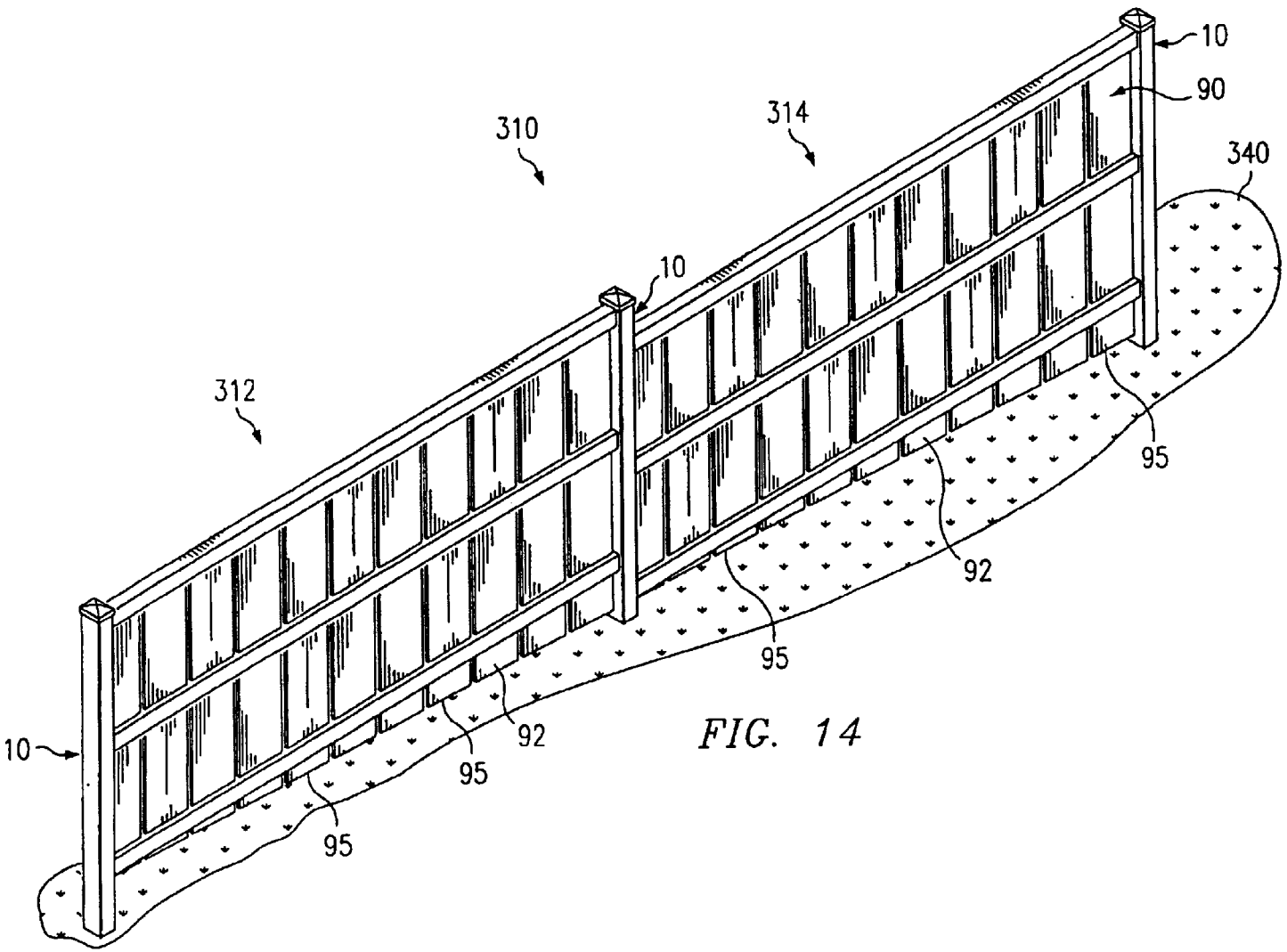
FIG. 14 illustrates two fence system units built on a sloping surface.

FIG. 14 depicts fence system 310 constructed on sloping surface 340. Fence panel system 310 has first fence panel 312 and second fence panel 314. Paling bottom ends 95 are trimmed to conform to the contour of the surface and rest on surface 340.

Referring to FIGS. 1–14, the fence post and rail assembly is assembled according to the following steps. Post 10 is placed in a surface. Bottom rail 70 is locked into post 10. Center rail 50 is locked into post 10. Paling 90 is dropped through center rail 50 and bottom rail 70. Top rail 30 is entered into post top aperture 16 and over a top end of paling 90. Top rail 30 is locked down into post 10 by fitting top rail slot 38 to post top aperture lower edge 18 of post 10. Post cap 12 is fitted over post 10 and pressed into position. As used herein, reference to strengthening bar 160 shall mean strengthening bar 160 or standard strengthening bar 180. Strengthening bar 160 is inserted into post aperture 14 and into bottom rail 70 so that the strengthening bar 160 straddles paling 90 and partially fills the interior cavity of bottom rail 70. Strengthening bar 160 projects outward from post 10 in the opposite direction from the assembled bottom rail 70 and top rail 30. Strengthening bar 160 projects outward from post 10 a distance equal to the distance that strengthening bar 160 projects into fence assembly unit 100. Center rail 50 is placed into post aperture 14 of post 10 so that center rail slot 58 engages post aperture lower edge 15. Strengthening bar 160 is inserted into post aperture 14 and into center rail 50 so that strengthening bar 160 straddles paling 90 and partially fills the space between the inside face 51 of center rail 50 and front face 92 of paling 90 so that strengthening bar 160 projects into an adjoining fence panel cavity for a distance equal to an installed section in the assembled fence panel. Bottom rail 70 is placed into post aperture 14 of post 10 and strengthening bar 160 is inserted into post aperture 14 and into bottom rail 70 so that strengthening bar 160 straddles paling 90 and partially fills the space between inside face 71 of bottom rail 70 and face 92 of paling 90 so that strengthening bar 160 projects into an adjoining fence panel cavity for a distance equal to an installed section in the assembled fence panel. The fence post and rail assembly can be disassembled by following the steps in reverse order.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. The spirit of the invention is not meant to be limited in any way except by proper construction of the following claims.

What is claimed is:

1. A fence unit comprising:

a post;

a rail engaged to said post;

a paling engaged to said rail; and a strengthening bar disposed within said rail and said post;

wherein said strengthening bar has a paling slot for engagement with said paling.

2. The fence of claim 1 wherein said post is vertically disposed relative to a surface.

3. The fence of claim 1 wherein said rail is at an approximate right angle to said post.

4. The fence of claim 1 wherein said paling is approximately parallel to said post.

5. The fence of claim 1 wherein said palings extend through the bottommost of said rails.

6. The fence of claim 1 wherein a stiffener is disposed within said post.

7. The fence of claim 1 wherein said rails further comprise:

a top rail containing an aperture for receiving said paling only on the lower side of said top rail; and at least one other rail containing apertures for receiving said paling on the upper side and the lower side of said other rail.

8. The fence assembly of claim 1 wherein said strengthening bar locates in said post and said rail to increase strength of assembled said post and said rail.

9. The fence assembly of claim 1 wherein said strengthening bar is of unitary construction.

10. The fence assembly of claim 1 wherein said strengthening bar is scored to facilitate cutting the strengthening bar in half.

11. The fence assembly of claim 1 wherein the said rail has a plurality of rail ribs for engagement with a plurality of strengthening bar rebates.

12. The fence assembly of claim 1 wherein the strengthening bar is made from poly vinyl chloride.

13. A fence comprising:

at least one post;

at least one rail engaged to said post; and at least one paling engaged to said rail and to a strengthening bar extending through a portion of an interior of the post and into the rail.

14. The fence of claim 13 wherein said post is vertically disposed relative to a surface.

15. The fence of claim 13 wherein said rail is at an approximate right angle to said post.

16. The fence of claim 13 wherein said paling is approximately parallel to said post.

17. The fence of claim 13 further comprising a plurality of palings extending through a bottom rail.

18. The fence of claim 13 wherein a stiffener is disposed within said post.

19. The fence of claim 13 wherein said rails further comprise:

a top rail containing an aperture for receiving said paling only on the lower side of said top rail; and at least one other rail containing apertures for receiving said paling on the upper side and the lower side of said other rail.

20. A method of constructing fence comprising:

erecting a post;

connecting a first rail to said post; and inserting at least one strengthening bar into said post and into said rail so that a paling slot on the strengthening bar engages the paling.

21. The method of claim 20 further comprising connecting a second rail.

22. The method of claim 21 further comprising inserting a paling through said first rail and said second rail.

23. The method of claim 20 further comprising attaching a post cap onto said post.

24. The method of claim 21 wherein said paling is perpendicular to said strengthening bar.

25. The method of claim 21 wherein said paling extends through the bottommost of said rails.

26. A fence post and rail assembly comprising:

a plurality of posts;

a plurality of rails connected to the posts;

a plurality of palings connected to the plurality of rails;

wherein each of said rails is located in a post and is strengthened by a strengthening bars that passes through the post and straddles a paling nearest to the post.

27. The fence post and rail assembly of claim 26 wherein each of said posts has three post openings at opposing sides of said post.

28. The fence post and rail assembly of claim 26 wherein each of said plurality of rails has a plurality of paling apertures equally spaced along a length of each of the rails.

29. The fence post and rail assembly of claim 26 wherein each of said plurality of rails has a projection at a rail end.

30. The fence post and rail assembly of claim 26 wherein a shape of the projection allows said rail to lock into said post openings.

31. The fence post and rail assembly of claim 26 wherein each of said palings has a thickness and width complementary to and substantially equal in dimension to the paling apertures in said plurality of rails.

32. The fence post and rail assembly of claim 26 wherein said strengthening bars are located in said plurality of posts and said plurality of rails.

33. The fence post and rail assembly of claim 26 wherein said strengthening bars project into an adjoining fence panel cavity for a distance equal to an installed section in an assembled fence panel.

34. The fence post and rail assembly of claim 26 wherein said strengthening bars have a height and width complementary to and substantially equal to a height of said post opening and of a interior cavity of said rail.

35. A method of constructing a fence post and rail assembly comprising:

placing a post in a surface;

locking a plurality of end projections of a rail into the post;

dropping a paling through a center rail and a bottom rail;

placing a top rail into a slot in a post top and over a paling top;

locking down said top rail into said post; and inserting a strengthening bar into a post opening and into said center rail so that the strengthening bar straddles the paling.

36. The method of claim 35 further comprising:

inserting a strengthening bar into a post opening and into said top rail so that the strengthening bar partially fills an interior cavity of the rail.

37. The method of claim 35 further comprising:

fitting a post cap over said post.

38. A strengthening bar for a fence post and rail assembly comprising:

a first end having a first paling receiving slot; and a second end having a first paling receiving slot.

39. The strengthening bar of claim 38 further comprising a scoring at an approximate center of a left surface, a right surface, a top surface and a bottom surface.

40. The strengthening bar of claim 38 further comprising each corner of said first end and said second end being rounded.

41. The fence post and rail assembly of claim 26 wherein each of said paling has a hollow interior reinforced by a plurality of perpendicular reinforcing members and by a plurality of diagonal reinforcing members.

42. The fence post and rail assembly of claim 26 wherein each of said palings is of unitary construction and has a solid interior.

43. The fence post and rail assembly of claim 26 wherein each of said palings is filled with a sound absorbing material.

44. The fence post and rail assembly of claim 26 wherein each of said palings is made with a combination of perpendicular reinforcing members, diagonal reinforcing members and sound absorbing material.

45. The fence and post rail assembly of claim 26 wherein each of said palings is extruded as a shell with a hollow interior and wherein a reinforcing interior is inserted into the shell and fixedly engaged to the shell.

46. The fence and post rail assembly of claim 26 wherein a stiffener is located in a bottom rail.

47. The fence and post rail assembly of claim 46 where a plurality of stiffeners are located in a bottom rail.

48. The fence and post rail assembly of claim 26 wherein a stiffener, located within a rail connected to a plurality of posts and to a second post of the plurality of posts, extends from an approximate center of the first post to an approximate center of the second post.

* * * * *

UNITED STATES PATENT AND TRADEMARK OFFICE

CERTIFICATE OF CORRECTION

PATENT NO. : 6,883,786 B2
DATED : April 27, 2005
INVENTOR(S) : Bebendorf

It is certified that error appears in the above-identified patent and that said Letters Patent is hereby corrected as shown below:

Column 2,
Line 19, insert a comma after “top rail”

Column 8,
Line 54, “bars” should be -- bar --

Signed and Sealed this

Seventh Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,883,786 B2
DATED : June 2, 2005
INVENTOR(S) : Bebendorf

It is certified that error appears in the above-identified patent and that said Letters Patent is hereby corrected as shown below:

Column 10,
Line 2, "first" should be -- second --

Signed and Sealed this

Twenty-sixth Day of July, 2005

JON W. DUDAS
*Director of the United States Patent and Trademark Office*